United States Patent [19]

Dykeman

[11] Patent Number: 4,735,003

[45] Date of Patent: Apr. 5, 1988

[54] PROTECTIVE TOE CAP FOR FOOTWEAR

[75] Inventor: John L. Dykeman, Halifax, Mass.

[73] Assignee: Haskon Corporation, Taunton, Mass.

[21] Appl. No.: 930,962

[22] Filed: Nov. 12, 1986

Related U.S. Application Data

[63] Continuation-in-part of Ser. No. 843,703, Mar. 25, 1986, abandoned.

[51] Int. Cl.[4] ..... A43C 13/14

[52] U.S. Cl. ..... 36/77 R; 36/72 R

[58] Field of Search ..... 36/72 R, 77 R, 77 M, 36/113

[56] References Cited

U.S. PATENT DOCUMENTS

| | | | |
|---|---|---|---|
| D. 157,124 | 2/1950 | Boughey | 36/72 R |
| 1,859,452 | 5/1932 | Mellerio | 36/77 R |
| 2,079,237 | 5/1937 | Allard | 36/72 R |
| 2,091,223 | 8/1937 | Binder | 36/72 R |
| 2,392,867 | 1/1946 | Stoner et al. | 36/72 R |
| 2,795,868 | 6/1957 | Shultz | 36/77 R |
| 3,407,518 | 10/1968 | MacQuaid et al. | 36/72 R |
| 3,593,438 | 7/1971 | Mitchell | 36/77 R |
| 3,950,865 | 4/1976 | Gray | 36/77 R |
| 4,575,953 | 3/1986 | Hetzel | 36/72 R X |

FOREIGN PATENT DOCUMENTS

| | | | |
|---|---|---|---|
| 0021612 | 1/1981 | European Pat. Off. | 36/72 R |
| 0095061 | 11/1983 | European Pat. Off. | 36/77 R |
| 2525443 | 10/1983 | France | 36/77 R |
| 487761 | 6/1938 | United Kingdom | 36/72 R |
| 678031 | 8/1952 | United Kingdom | 36/77 R |
| 1284736 | 8/1972 | United Kingdom . | |

*Primary Examiner*—Stephen Marcus
*Assistant Examiner*—T. Graveline
*Attorney, Agent, or Firm*—McCormick, Paulding & Huber

[57] ABSTRACT

A toe cap for internally reinforcing the toe of safety shoes, boots, and the like to protect the wearer against heavy compression or impact loads is made from a plastic material, and is designed with a flexible roof region in order to shift stresses generated by such loads to the lateral and forward wall regions which are more capable of supporting the loads and yield higher load-carrying capacities.

23 Claims, 5 Drawing Sheets

PROTECTIVE TOE CAP FOR FOOTWEAR

CROSS-REFERENCES TO RELATED APPLICATIONS

This application is a continuation-in-part of co-pending Application Ser. No. 843,703 filed Mar. 25, 1986, abandoned.

BACKGROUND OF THE INVENTION

The present invention relates to footwear, and is concerned in particular with the shoes, boots, and overshoes which contain toe caps that structurally reinforce the toe of the footwear and protect the wearer from injury caused by objects which fall or roll onto the toe.

Shoes, boots, and other footwear with internal toe caps for structural reinforcement are old in the art and have been sold commercially for many years. Such footwear is worn by industrial workers, firemen, lumberjacks, military personnel, and many other people who work in environments where the potential for injury to the foot due to heavy objects is relatively high. Until recently, all toe caps have been made from metal, specifically steel, because the greatest strength could be derived from such a material in limited wall thicknesses.

Several constraints are imposed on the design of the toe cap and necessitate a shell-like structure. First of all, the cap must be hollow in order to envelop the toes of the wearer in a protective pocket, and the hollow pocket of the cap must have the same approximate volume and shape as an ordinary shoe in the toe area for fit and comfort. Furthermore, for reasons of comfort and practicality, the toe cap must be lightweight, and for practicality and esthetics, the toe cap should fit within the general contours of a shoe toe.

More recently, non-metallic toe caps made of plastic have appeared on the market in place of the steel toe caps of the prior art. Plastic toe caps offer a number of advantages over steel caps. Plastic toe caps are lighter in weight which results in less fatigue to the wearer during extended periods of use. Plastics also have much lower heat conductivity, and therefore they offer much more comfort to the wearer in cold weather and reduce the danger of frostbite.

Plastics in general are not ductile, and as a result, when they are stressed beyond their limits, they flex first to a limited degree and then fracture. When the load or weight is removed from the safety shoe, the toes of the wearer are immediately freed from the stress.

Metal, on the other hand, when stressed beyond its yield point, permanently deforms with or without some fracturing, and in a safety shoe such permanent deformation and any crushing effect upon the toes is not reversed when the object or other load which caused the deformation is removed. In such a situation, the steel toe caps make removal of the shoe difficult and raise the possibility of further pain and suffering.

Plastic toe caps are also nonmagnetic and can be rendered electrically conductive or nonconductive as desired. Plastic caps do not corrode and hence are not affected by moisture and perspiration.

A primary concern when a steel toe cap is replaced by plastic is the adequacy of the structural reinforcement since substantially all plastics have tensile and compressive strengths that are less than those for steel. Recognized standards exist both in the United States and foreign countries for testing and acceptance of toe caps. In the United States, the toe caps must meet compression and impact tests according to ANSI Standard Z41-1983, of the American National Standards Institute, New York, N.Y. In Europe, toe caps are tested for impact resistance according to DIN Standard 4843. Prior to the development of the toe cap of the present invention, it is believed that no plastic toe cap produced on a commercial scale complied with such standards. It is accordingly an object of the present invention to provide a plastic toe cap for footwear which provides all of the recognized advantages of plastic toe caps in a design that is capable of meeting the applicable strength standards.

SUMMARY OF THE INVENTION

The present invention resides in a non-metallic toe cap for use in footwear to provide structural reinforcement of the toe area against compression and impact loading.

The toe cap is comprised by a shell body made from a plastic material and has the shape of a shoe toe with a rearward facing opening at the entrance of the toe pocket. A roof region of the shell body extends forwardly to a front wall region and laterally to lateral wall regions disposed at opposite sides of a central plane.

The lateral and front wall regions project upwardly from a generally planar base that is shaped to conform to the generally elliptical front part of the shoe sole, and the wall regions join the roof region with smoothly contoured curves to form a continuous and rounded shell body.

In accordance with the present invention, the roof region of the toe cap includes means for shifting the stresses and fracture point under compression and impact loads outwardly from the central plane to the wall regions. The wall regions which project generally vertically upward support such loads more satisfactorily and at higher load levels so that a safe and more comfortable toe cap is obtained.

The means for shifting the loads from the roof to the wall regions is comprised by means for rendering the roof region of the cap flexible so that the applied loads are distributed elsewhere and are supported primarily by the wall sections. The means providing the flexibility may include a series of grooves extending longitudinally through the roof of the wall region, a reduced wall section in the roof region, a different plastic material having a lower modulus of elasticity than the rest of the toe cap and combinations of these means.

DESCRIPTION OF PREFERRED EMBODIMENTS

Figure 1:
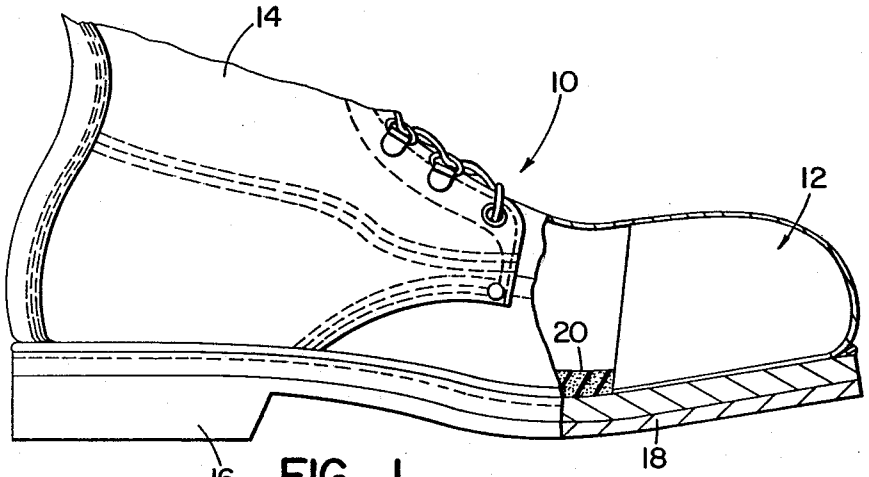
FIG. 1 is a side elevation view of a safety shoe with the toe portion cut away to illustrate the toe cap of the present invention.

FIG. 1 illustrates a safety shoe, generally designated 10, with an internal non-metallic toe cap 12 in accordance with the present invention. The cap 12 is installed in the toe area to provide structural reinforcement of the shoe against compression and impact loads that arise from objects falling or shifting onto the toe area. The toe cap 12 may also be installed in other types of footwear, such as boots and toe protectors that slip over the shoe or toe areas of the shoe for safety and protection.

The safety shoe 10 is of a conventional construction having leather, rubber, or synthetic uppers 14, a heel 16, a hard rubber or leather outer sole 18, a cushioned insole 20, and other comfort features, such as internal lining and collars. The shoe may in addition have a reinforced heel area, protective shanks in the sole for intrusions from below, and other safety features as desired. The toe cap 12 is mounted on top of the sole 18 and within the contours of the upper 14 in the toe area.

FIGS. 2–5 illustrate non-metallic the toe cap 12 of the present invention in greater detail. The toe cap is basically a shell body that is constructed entirely from plastic material. In this respect, the term "plastic" applies to a variety of synthetic materials including both thermoplastic and thermosetting resins with and without fiber reinforcement. Examples of suitable thermoplastic resins are polyvinylchloride (PVC), ABS (a polymerized mixture of styrene, acrylonitrile, and nitrile rubber), polycarbonates, polyethylene, polyethylene terephthalate, polypropylene, polyurethane, polyphenylene sulfide, polyetheretherketone, polyetherimide, polyamide-imide, and blends of these plastics. Examples of suitable thermosetting resins which can be used with selected reinforcing fibers and fillers include phenolics, polyesters, epoxies, polyamides, and polyacrytamates.

The plastic materials referred to above may be reinforced with glass fibers and fibers of carbon, graphite, and Kevlar.

In general, the toe caps 12 of the present invention are made by molding in various fashions. Compression molding, injection molding, or resin transfer processes, as well as injectioncompression molding and pressure forming are suitable for the various resins discussed above. When resin reinforcement is desired, the injection molding technique should be avoided unless precautions are taken to prevent fiber length degradation and development of generally parallel fiber orientation in the finished part.

One example of the toe cap construction in accordance with the present invention was made from a polyphenylene sulfide (PPS) plastic with glass reinforcement. The PPS plastic with glass fiber reinforcement was first preheated in an oven system as a precut preform of proper weight, then hot-formed under pressure in a cool compression mold to the final configuration. The fiber reinforcement was 40% by weight of the finished product and used swirl mat fiberglass.

Another example of the toe cap construction in accordance with the present invention was made with a polyurethane plastic with glass fiber reinforcement preheated in an extruder or plasticizer. A slug of the material of appropriate weight was then placed in the compression mold and formed under pressure to the final configuration of the toe cap. The length of the glass fibers in the initial charge ranged between half-inch to two inches but the length of the longer fibers was reduced as the material passed through the plasticizer to a range of one-quarter inch to one inch. The volume ratio of polymer to glass fiber was approximately 60%. Higher percentages including 100% plastic without reinforcing fibers are also possible.

The toe cap 12 of FIGS. 2–5 is a unitary structure having a hollow shell body in the general shape of a shoe toe. The body has a rearward-facing opening 26 for insertion and withdrawal of the toes when the shell is mounted in the shoe and defines the toe pocket.

More significantly, the shell body includes a roof region 30 at the top of the toe cap, a front wall region 32 at the forward part of the toe cap, a right wall region 34, and a left wall region 36. The left and right wall regions 34,36 are disposed generally equidistant from a longitudinal central plane 38 along which the toe cap is sectioned in FIG. 5. The various roof and wall regions are generally outlined by the dashed lines in FIG. 3, but it should be understood that the precise boundary line of each region is not critical, and all of the regions are joined together by smooth continuous curves to fit within the toe of a shoe or other footwear with an esthetically pleasing external shape and an internal shape conforming to the last or form on which shoes are constructed.

Figure 3:
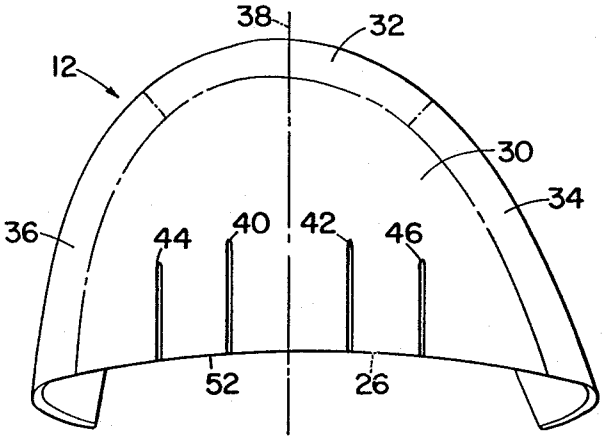
FIG. 3 is a top plan view of the toe cap.
Figure 4:
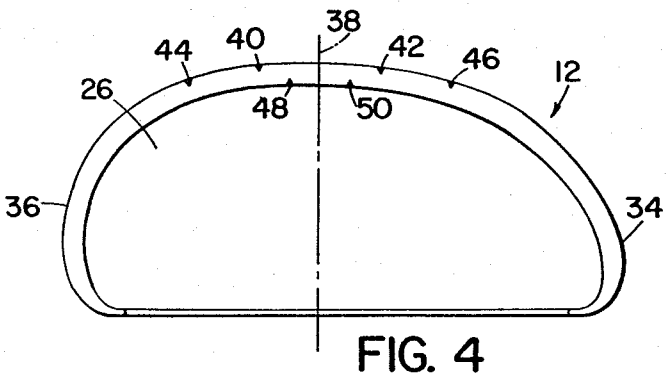
FIG. 4 is a rear elevation view of the toe cap.
Figure 2:
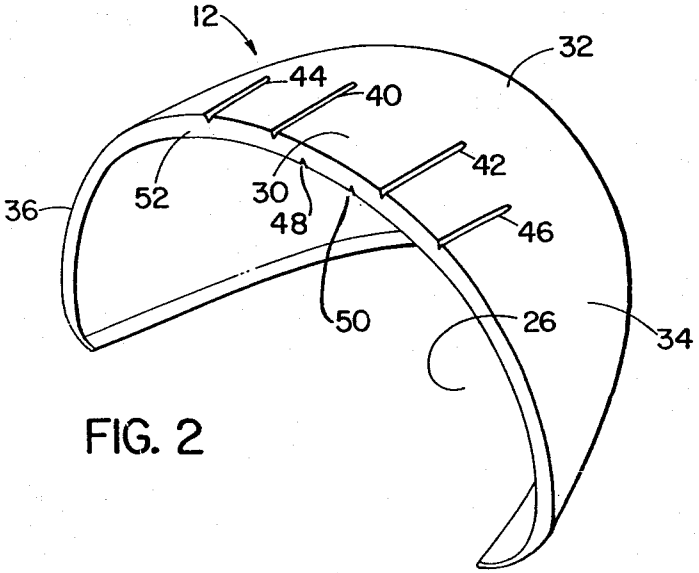
FIG. 2 is a perspective view of the toe cap illustrated in the shoe of FIG. 1.
Figure 5:
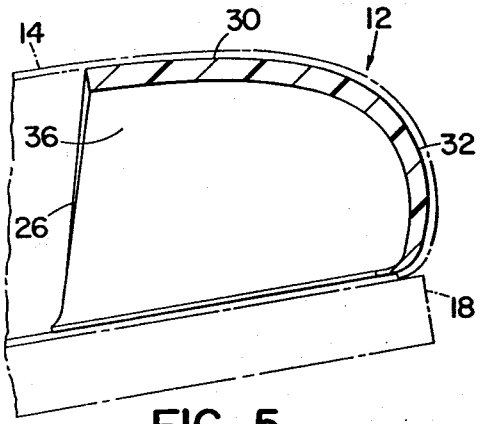
FIG. 5 is a side elevation view of the toe cap sectioned along the central fore and aft plane.

The wall regions 32, 34, and 36 project vertically upward from a generally planar base 37, as is clear from the illustrations in FIGS. 4 and 5, and they conform generally to the front part of the shoe sole, as is apparent from FIGS. 2 and 3. The bottom edges of the wall regions are curved inwardly as shown in order to provide a wide seat for resting the toe cap 12 against the shoe sole. The toe cap can be glued or otherwise secured to the sole and the upper, or the cap can simply be held in place within the toe of the shoe by the surrounding material. Recesses in the sole can be provided as well to accept the lower edges of the wall regions, and stitching between the upper and a lining within the shoe can be used to hold the toe cap in place.

The roof region 30 extends horizontally with a generally arcuate shape in both longitudinal and lateral planes. As shown in FIGS. 4 and 5, the uppermost point of the arcuate shape lies at a position slightly in front of the rear edge of the toe cap and in the central plane. The uppermost point is positioned strategically to make first contact with the objects that fall or slide onto the shoe toe.

The toe cap 12 of FIGS. 2–5 does not contain a floor section, since the shoe sole 18 normally closes the bottom of the toe pocket in the shoe. However, the toe cap 12 can be constructed with a floor section if no other sole reinforcement is provided, and in that event, the wearer of the shoe would be protected from objects which would otherwise pierce the shoe sole from below and possibly cause injury to the toes.

In accordance with the present invention, the toe cap 12 is designed with a roof region that includes means for shifting load stresses outwardly away from the central plane 38 to the wall regions 32, 34, and 36. The illustrated means for shifting comprises a plurality of grooves 40, 42, 44, 46, 48, and 50 which extend longitudinally in the roof region from the rearwardmost edge 52 to positions intermediate the front and rear edge of the cap. The number and length of the grooves varies depending upon the design of the toe cap. In wider caps a greater number of grooves are distributed across the greater expanse of a roof region, and in caps having greater front-to-rear dimensions, the grooves are longer to achieve the desired load shifting as explained further below. The grooves can be placed solely on the interior or exterior surfaces of the shell body; however, with high crown caps, the grooves are preferably located on both surfaces.

As shown in FIG. 4, the grooves penetrate only partially into the roof section from the exterior and interior surfaces for the purpose of rendering the roof region more flexible to loads that are applied to the top of the toe cap. Such flexibility has the effect to shifting the resistance or forces reacting to the loads from the roof region to the wall regions which, being vertically oriented, are more capable of supporting the loads without bending and fracturing.

Figure 6:
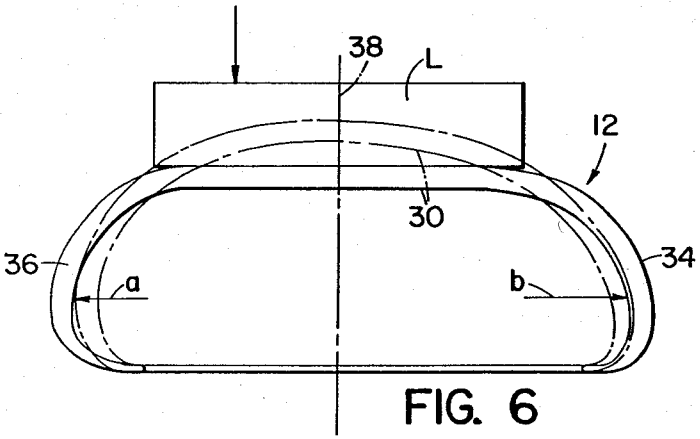
FIG. 6 is another rear view of the cap and shows the reaction of the cap to a compression load.

To further understand the invention, FIG. 6 illustrates the deflection that occurs in the novel toe cap 12 when a load L is placed on the roof region 30. The unloaded, undeflected position of the roof region is illustrated in phantom. The solidline deflected position indicates the larger degree of deflection and flattening that the roof region undergoes, and the consequential spreading of the load laterally over the roof region 30 toward the walls 34,36. In this manner, critical stresses from the load L are relieved in the central part of the arcuate roof region 30 and are are shifted from the central or apex part outwardly toward the wall regions 34 and 36. A similar shifting toward the front wall 32 occurs simultaneously.

It has been established from tests of toe caps that fracturing without the flexible roof section normally takes place in the central plane 38 at the rear edge of the roof region. However, when the roof is made flexible in accordance with the present invention, the roof region deflects without fracture under load, and ultimate failure, i.e. fracture, occurs in the lateral wall regions at the areas identified by the arrows a or b.

More significantly, however, ultimate failure of the toe cap 12 constructed with the flexible roof region occurs at a much higher load level than that of a conventional plastic toe cap. This is attributable primarily to the fact that the load stresses are not borne by the roof section itself due to its flexibility, and as a consequence, the loads are shifted outwardly and are borne by the lateral wall regions. The wall regions project vertically upward from the shoe sole and therefore are more suitably oriented to support such loads without fracture. As a result, for a plastic toe cap of a given size and weight, higher loads can be supported without structural failure when the roof region is designed with flexibility in accordance with the present invention.

Figure 10:
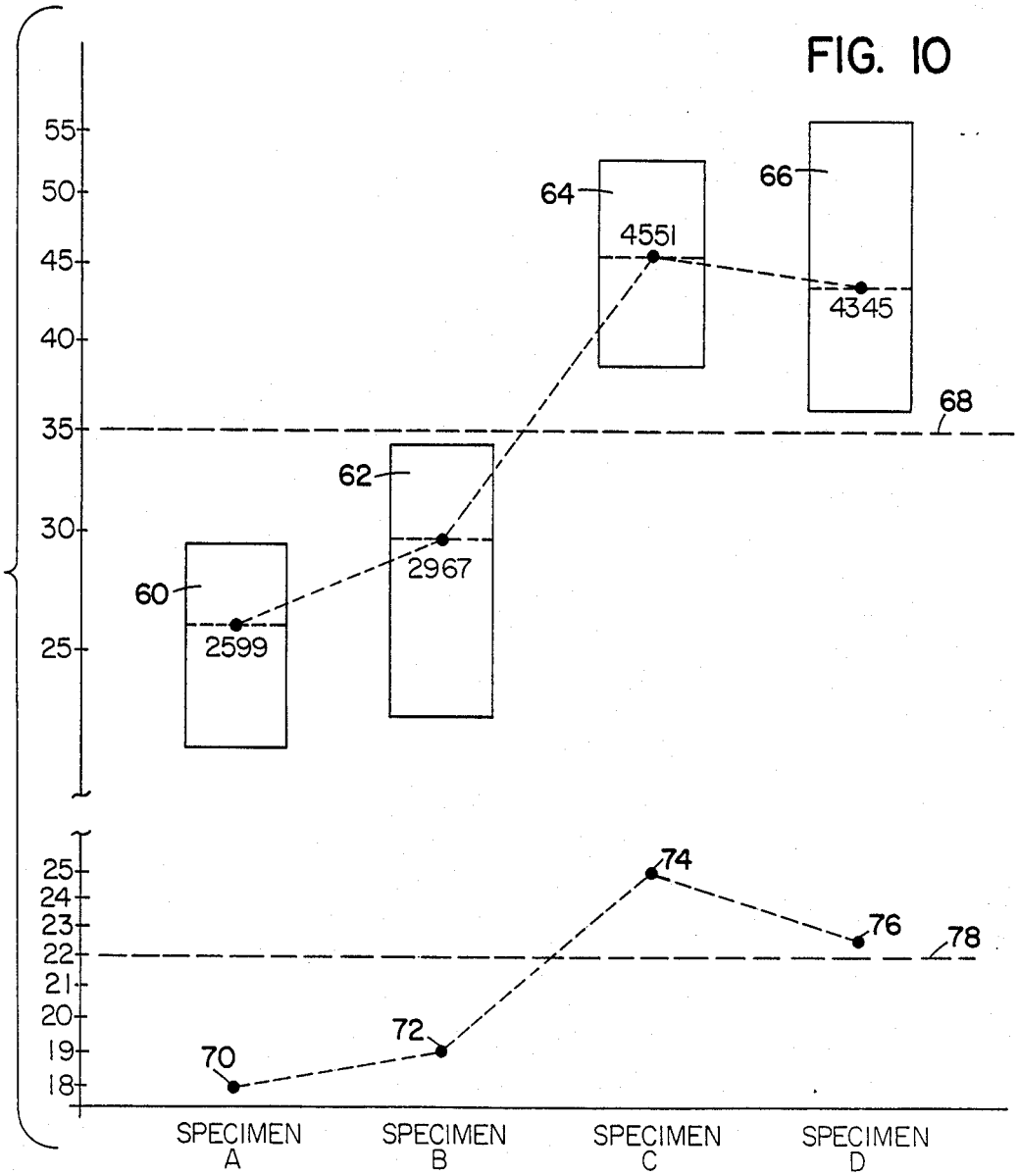
FIG. 10 is a chart illustrating the compression and impact tests on various toe caps.

FIG. 10 illustrates the results of compression and impact tests that have been compiled for several caps made from a plastic material. Specimen A defines a cap made from a fiber reinforced plastic having the same general configuration as that illustrated in the drawings of this application but with a generally uniform wall thickness throughout. The tests were conducted to ensure compliance with the American National Standard (ANSI Z41-1983) for both compression and impact loading. Under this Standard, failure occurs when the toe cap collapses to such a degree that a half-inch feeler gauge (steel rod) will not slide in and out of the opening 26 at the rear edge of the cap.

Compression tests for the specimen A produced the results falling within box 60. The top and bottom limits of the box represent the upper and lower load limits at which several specimens of the A type failed, and the number and data point at the center of the box represents the average failure load for the specimens. The load level labeled 68 in the figure represents the compression load level that ensures acceptance under the referenced ANSI Standard Z41.

The data points 70,72,74, and 76 represent the results for impact load tests to determine if the caps are in compliance with the referenced ANSI Standard. The fraction numerals represent the height of the toe pocket within the toe gap in inches after the test, and the level that ensures acceptance according to ANSI Standard Z41-1983 is labeled 78.

Specimen B was structurally similar to specimen A but shows somewhat improved results at box 62 and point 72 in comparison to Specimen A due to process improvements that assured controlled fiber length and more uniform fiber distribution in the finished part. While these improvements raised the level of both the compression and impact results, the acceptance levels 68 and 78 were not reached.

Specimen C was constructed from a fiber reinforced plastic with a flexible roof region established by grooves as shown in FIGS. 2–5. It is apparent from the results (64,74) that this specimen consistently passed both the impact and compression tests in accordance with the ANSI Standard. The compression test results for Specimen C are not only higher than that for any other specimen, they are also more repeatable, which is indicated by a smaller separation between the upper and lower limits of the box 64.

Figure 7:
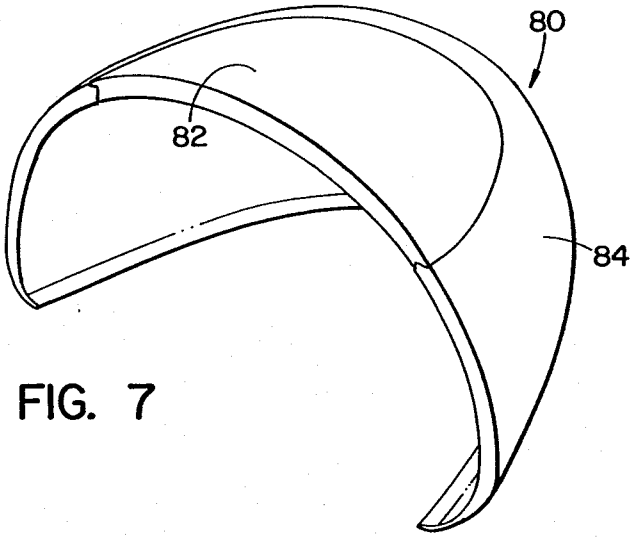
FIG. 7 is a perspective view of another embodiment of the toe cap.
Figure 8:
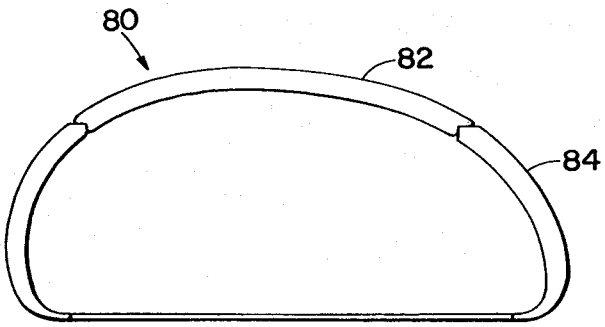
FIG. 8 is a rear elevation view of the toe cap in FIG. 7.

FIGS. 7 and 8 illustrate a toe cap 80 which constitutes a further embodiment of the present invention. The toe cap 80 is constructed of plastic materials and has the same shape as the toe cap 12 in FIGS. 1–5. The principal difference in the body structure resides in the formation of a compound structure in which the roof region 82 is a piece distinctly different from the wall regions 84. In other words, the toe cap 80 does not have an integral shell body, but a shell body consisting of two separate pieces.

The roof region 82 can be joined to the wall regions 84 by mechanical means such as a snap-type fitting or it can be bonded in place with epoxy or other resins compatible with the plastic material of the roof and wall.

The toe cap 80 functions in a manner similar to the toe cap 12 in that the roof region 82 is designed with sufficient flexibility to cause the load stresses on top of its arcuate shape to be shifted outwardly away from the central plane to the wall regions 84. Such flexibility is achieved by constructing the roof region 82 with a thinner wall section that affords such flexibility or with materials that have a lower modulus of elasticitiy or both. For example, the roof region 82 can be constructed from a different type of plastic than the wall region 84 or the plastic for the wall region can be fiber reinforced while the roof region 82 is without fiber reinforcement.

Figure 9:
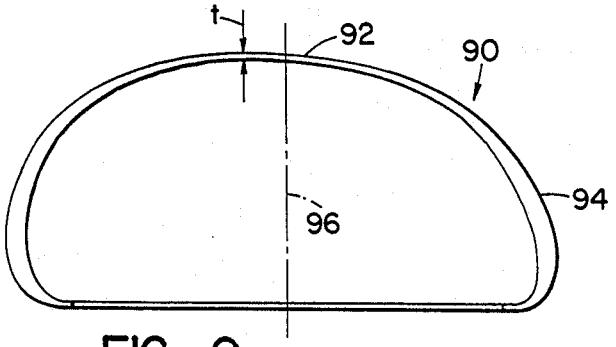
FIG. 9 is a rear elevation view of still another embodiment of the invention.

FIG. 9 discloses another toe cap 90 which constitutes still a further embodiment of the present invention. The toe cap 90 is similar in shape to the embodiments 12 and 80 discussed above and contains a roof region 92 and a wall region 94. Unlike the toe cap 80, the cap 90 has an integral or one-piece construction and is made entirely from a single type of plastic material with limited or no fiber reinforcement.

The cap 90 in accordance with the present invention achieves a flexible roof region 92 by reducing the wall thickness t of the arcuately shaped roof region so that compression and impact loads will more easily deflect the roof region and cause the fracture stresses to shift or occur first in the wall regions rather than the roof region as discussed above in connection with FIG. 6. For example, if the wall regions have a thickness of 0.25 inches, the roof region would have a reduced wall thickness of 0.05 inch.

At the portions of the roof region 92 more remote from the central plane 96, the wall thickness increases gradually so that it blends smoothly into the curves of the lateral and front wall regions without noticeable change in the inner and outer surfaces of the shell body. The compression and impact test results for caps constructed in the same manner as the cap 90 are illustrated in FIG. 10 and are labelled as Specimen D. Both the compression test results shown in box 66 and the impact test result shown at point 76 exceed the acceptance levels.

Figure 11:
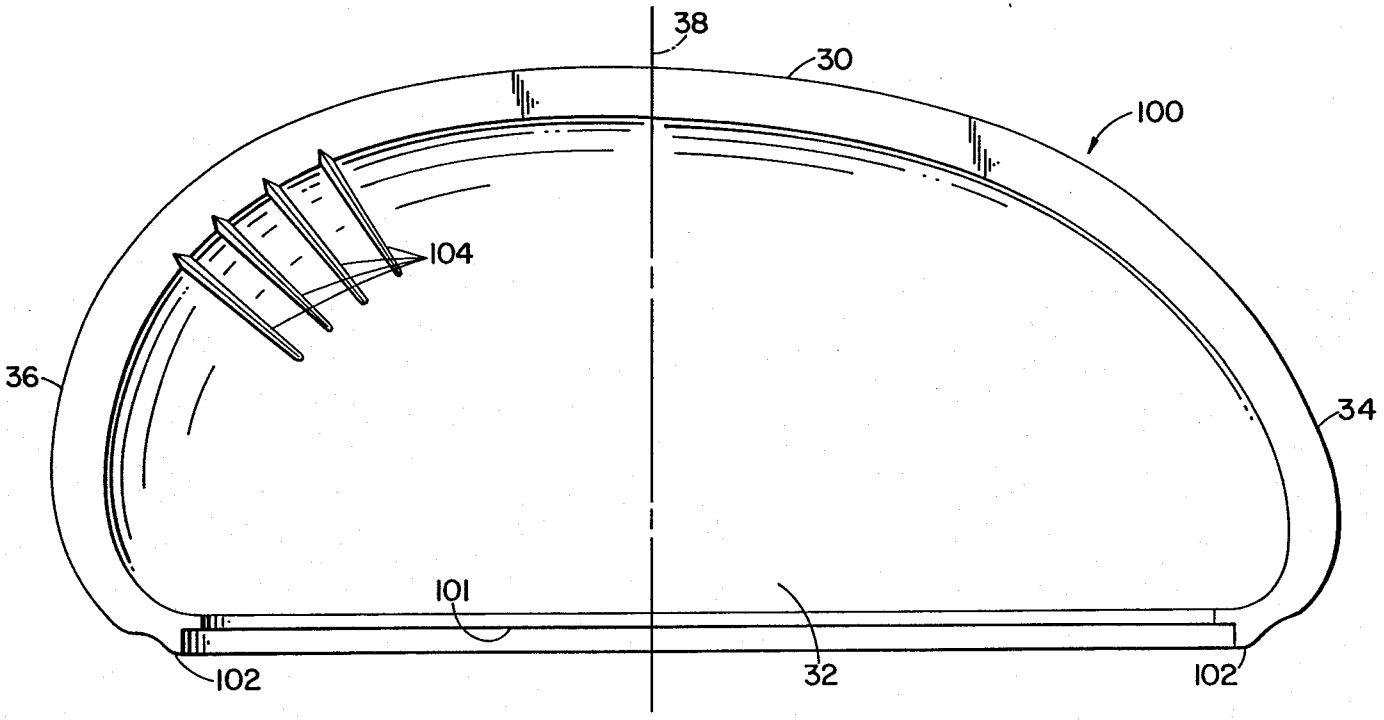
FIG. 11 is a rear elevation view of still another embodiment of the invention.

FIG. 11 discloses still another toe cap 100. In accordance with the present invention the roof region 30 of the toe cap 100 is made flexible either by grooves 104 such as the grooves described in the toe cap 12 or by material or thickness controls as indicated in the toes 80 and 90. Such flexibility allows the roof region to flex under load which simultaneously transfers the load to the wall regions 32, 34 and 36.

The toe cap 100 differs principally from the toe cap 12 in that the planar base 101 of the cap contains a projection or ridge 102 that extends downwardly away from the base and runs at least along the bottom side of the sidewall regions 34, 36 and preferably along the front wall region as well. The projection 102 rests on the sole of the finished shoe shown in FIG. 1 and penetrates into the sole under compression or impact loading to thereby engage the sole and prevent the lateral wall regions 34 and 36 from spreading outwardly at the bottom.

Such spreading of the lateral walls under load reduces the strength of the toe cap and height of the toe cap in the central plane 38 and allows the roof 30 to collapse by an impermissible amount. The projection 102 prevents the spreading of the walls by locking the base of the walls to the underlying shoe sole. In effect the sole closes the opening across the bottom of the molded cap which increases the shell strength of the cap. Therefore, load transfer from the roof region to the wall regions can take place without significant loss of clearance between the roof and sole.

The toe cap 100 also illustrates the grooves 104 at an asymmetric position with respect to the central plane 38 for introducing the required flexibility into the roof section. This positioning illustrates the fact that flexibility can be designed into the different sections of the roof region as needed to provide a load transfer which is most suitable for a particular toe design.

Accordingly, a toe cap has been disclosed which can be formed entirely from a plastic material and have strength characteristics which allow the lateral and forward wall regions to support compression and impact loads that would normally fracture the roof region of the cap near the central longitudinally extending plane. The roof region of the cap is designed to be flexible so that under load, fracture level stresses are shifted to the lateral and forward walls of the cap. Because the walls are generally vertical and capable of supporting higher compression and impact load levels before fracture occurs, a stronger toe cap is formed.

While the present invention has been described in several preferred embodiments, it should be understood that numerous modifications and substitutions can be made without departing from the spirit of the invention. Various types of plastic materials with and without fiber reinforcement can be employed. The flexibility is introduced into the roof region of the cap by controlling the wall thickness, by substitutions of materials, and by structurally modifying the roof through grooves, bored holes, and other means. Accordingly, the present invention has been described in several preferred embodiments by way of illustration than limitation.

I claim:

1. A non-metallic toe cap for installation in footwear to provide structural reinforcement of the toe area against compression and impact loading comprising:

a shell body made from a plastic material and having the shape of a shoe toe with a rearward facing opening at the entrance of a toe pocket for insertion and withdrawal of the toes, the body including a roof region extending forwardly to a front wall region and laterally from a generally uppermost elevation at a central plane to opposite lateral wall regions, the lateral and front wall regions being joined with each other and with the roof region by smooth continuous curves conforming to a shoe toe to form the shell body, the wall regions also projecting upwardly away from a generally planar base shaped to conform to the front part of a shoe sole, and the roof region having means for shifting the fracture point of the plastic material under compression and impact loads outwardly from the central plane of the roof region toward locations in the lateral wall regions.

2. A non-metallic toe cap as defined in claim 1 wherein the means for shifting comprises means for providing the roof region with flexibility sufficient to deflect under compression and impact loads without fracture of the plastic material at the central plane and thereby shift load stresses outwardly from the plane toward locations in the lateral wall regions.

3. A non-metallic toe cap as defined in claim 2 wherein the means for shifting comprises means defining a series of grooves extending parallel to the central plane in the roof region of the body shell and partially penetrating into the plastic material to increase the flexibility of the roof region.

4. A non-metallic toe cap as defined in claim 3 wherein the grooves are located on the exterior surface of the roof region.

5. A non-metallic toe cap as defined in claim 3 wherein the grooves are located on the interior surface of the roof region.

6. A non-metallic toe cap as defined in claim 3 wherein the grooves are located on the interior and exterior surfaces of the roof region.

7. A non-metallic toe cap as defined in claim 2 wherein the means for shifting comprises a roof region having a reduced wall thickness adjacent the central plane to provide said flexibility in the roof region at a position remote from the lateral wall regions toward which the load stresses are shifted.

8. A non-metallic toe cap as defined in claim 2 wherein the means for shifting comprises a roof region composed of a plastic material different from the plastic material of the front and lateral wall regions.

9. A non-metallic toe cap as defined in claim 1 wherein the shell body is made from a thermoplastic material.

10. A non-metallic toe cap as defined in claim 1 wherein the shell body is made from a thermoset plastic material.

11. A non-metallic toe cap as defined in claim 1 wherein the shell body is made from a fiber reinforced plastic resin.

12. A non-metallic toe cap as defined in claim 1 wherein:

the roof region is arcuately shaped in longitudinal and lateral planes, and the point on the exterior of the roof region most distant from the base plane is located in the central, longitudinal plane.

13. A non-metallic toe cap as defined in claim 12 wherein the point on the exterior of the roof region most distant from the base plane is located forward of the rear edge of the roof region.

14. In a reinforced safety shoe or the like, a non-metallic toe cap comprising a shell body formed from plastic in the shape of the shoe toe and fitting within the front portion of the shoe, the body having a roof region on the top, lateral wall regions disposed at opposite sides and joined with a front wall region and the roof region to form a generally smooth, continuous body with a generally planar base mating with the shoe sole, the roof region having an arcuate shape in a plane transverse to a central plane, the central plane extending fore and aft intermediate the lateral wall regions, the roof region including means for shifting fracture stresses in the plastic material of the roof region outwardly away from the central plane of the roof region toward the lateral wall regions.

15. A non-metallic toe cap as defined in claim 14 wherein the means for shifting the stresses comprises means rendering the roof region flexible relative to the wall regions under compression and impact loads applied near the central plane of the roof region.

16. A non-metallic toe cap as defined in claim 15 wherein the means for rendering comprises means defining a series of grooves extending parallel to the central plane in the roof region of the toe cap and penetrating into surface of the generally smooth, continuous shell body.

17. A non-metallic toe cap as defined in claim 16 wherein the series of grooves extends forwardly in the roof region from the rear edge of the toe cap to positions in the roof region intermediate the front of the cap and the rear edge of the roof region.

18. A non-metallic toe cap as defined in claim 15 wherein the means for rendering the roof region flexible comprises a roof region of reduced wall thickness.

19. A non-metallic toe cap as defined in claim 15 wherein the means rendering the roof region flexible comprises a roof region constructed of another plastic material more flexible than the material forming the wall region.

20. A non-metallic toe cap in a reinforced safety shoe as defined in claim 14 wherein:

the roof region of the shell body also has an arcuate shape along the central plane between the rear edge of the roof region and the front wall region, and the maximum height of the roof region in the central plane above the base is located forward of the rear edge of the roof region.

21. A non-metallic toe cap as defined in claim 1 further including means positioned on the planar base for engaging an underlying shoe sole.

22. A non-metallic toe cap as defined in claim 20 wherein the means for engaging comprises a projection extending downwardly away from the planar base under the wall regions.

23. In a non-metallic reinforced safety shoe or the like having a sole, a toe cap according to claim 14 further including means for engaging the lower wall regions of the toe cap with the shoe sole to prevent the wall regions from spreading outwardly under load.

* * * * *